US009484647B2

(12) United States Patent
Ishikawa et al.

(10) Patent No.: US 9,484,647 B2
(45) Date of Patent: Nov. 1, 2016

(54) TERMINAL BLOCK

(71) Applicants: Kohki Ishikawa, Tokyo (JP); Shigeru Ishikawa, Sagamihara (JP); Kazunori Sato, Sagamihara (JP)

(72) Inventors: Kohki Ishikawa, Tokyo (JP); Shigeru Ishikawa, Sagamihara (JP); Kazunori Sato, Sagamihara (JP)

(73) Assignee: FUJIKURA LTD., Tokyo (JP)

( * ) Notice: Subject to any disclaimer, the term of this patent is extended or adjusted under 35 U.S.C. 154(b) by 399 days.

(21) Appl. No.: 13/956,903

(22) Filed: Aug. 1, 2013

(65) Prior Publication Data

US 2013/0322049 A1 Dec. 5, 2013

Related U.S. Application Data

(63) Continuation of application No. PCT/JP2012/052411, filed on Feb. 2, 2012.

(30) Foreign Application Priority Data

Feb. 4, 2011 (JP) ..... 2011-022956

(51) Int. Cl.
*H01R 9/24* (2006.01)
*H01R 13/502* (2006.01)
(Continued)

(52) U.S. Cl.
CPC ..... *H01R 9/24* (2013.01); *H01R 13/502* (2013.01); *H01R 13/6215* (2013.01); *H01R 43/005* (2013.01); *H01R 11/12* (2013.01); *H01R 13/521* (2013.01); *H01R 2105/00* (2013.01); *H01R 2201/26* (2013.01)

(58) Field of Classification Search
CPC .. H01R 13/502; H01R 13/6215; H01R 9/24; H01R 43/005; H01R 4/30; H01R 4/302; H01R 11/12; H01R 13/514; H01R 13/521; H01R 2105/00; H01R 2201/26
USPC ..... 439/709, 701, 801, 810, 76.2, 271, 364, 439/519, 939
See application file for complete search history.

(56) References Cited

U.S. PATENT DOCUMENTS 5,368,506 A * 11/1994 Heimbrock ..... H01R 13/115 439/709
5,580,286 A * 12/1996 Kramer ..... H01R 4/30 439/801

(Continued)

FOREIGN PATENT DOCUMENTS

CN 101626125 A 1/2010
CN 101820118 A 9/2010

(Continued)

OTHER PUBLICATIONS

Japanese Office Action dated Jun. 24, 2014, issued in Japanese Patent Application No. 2012-555958 (2 pages).

(Continued)

*Primary Examiner* — Tulsidas C Patel
*Assistant Examiner* — Travis Chambers
(74) *Attorney, Agent, or Firm* — Westerman, Hattori, Daniels & Adrian, LLP

(57) ABSTRACT

A male connector (10) comprises: a male-side inner housing (30) which holds a plurality of male terminals (20) so as to expose circular portions (22) of the male terminals (20); and a partition member (40) which includes a rib (41) dividing the circular portions (22) of the plurality of the male terminals (30), and the male-side inner housing (30) and the partition member (40) are configured to be separate from each other.

2 Claims, 14 Drawing Sheets

(51) Int. Cl.

| | |
|---|---|
| ***H01R 13/621*** | (2006.01) |
| ***H01R 43/00*** | (2006.01) |
| *H01R 105/00* | (2006.01) |
| *H01R 11/12* | (2006.01) |
| *H01R 13/52* | (2006.01) |

(56) References Cited

U.S. PATENT DOCUMENTS

| | | | | |
|---|---|---|---|---|
| 6,188,560 | B1 * | 2/2001 | Waas | H01R 4/2408 361/119 |
| 7,572,150 | B2 * | 8/2009 | Matsuoka | H01R 13/207 439/626 |
| 8,192,238 | B2 * | 6/2012 | Majewski | H01R 4/34 439/801 |
| 8,317,544 | B2 * | 11/2012 | Matsuoka | H01R 4/64 439/607.55 |
| 8,562,381 | B2 * | 10/2013 | Kawamura | H01R 11/12 439/801 |
| 9,017,099 | B2 * | 4/2015 | Ikeda | H01R 13/748 439/559 |
| 2004/0266269 | A1 | 12/2004 | Miyazaki | |
| 2010/0009566 | A1 | 1/2010 | Sakakura et al. | |
| 2010/0215322 | A1 | 8/2010 | Matsumoto et al. | |
| 2010/0261365 | A1 | 10/2010 | Sakakura | |
| 2013/0260585 | A1 * | 10/2013 | Wang | H01R 13/5202 439/271 |
| 2014/0322973 | A1 * | 10/2014 | Okamoto | H01R 13/4223 439/587 |

FOREIGN PATENT DOCUMENTS

| | | | |
|---|---|---|---|
| EP | 2144332 | A1 | 1/2010 |
| JP | 2005-019188 | A | 1/2005 |
| JP | 2005-251507 | A | 9/2005 |
| JP | 2006-031962 | A | 2/2006 |

OTHER PUBLICATIONS

Extended European Search Report dated Jun. 13, 2014, issued in European Patent Application No. 12742664.1 (6 pages).

Chinese Office Action dated Dec. 31, 2014, issued in Chinese Application No. 201280005755.X. (5 pages).

International Search Report for PCT/JP2012/052411, Mailing date of Apr. 3, 2012.

Chinese Office Action dated Nov. 3, 2015, issued in Chinese Application No. 201280005755.X. (4 pages).

Office Action dated Jun. 12, 2016, issued in counterpart Chinese Application No. 201280005755, with English translation (10 pages).

* cited by examiner (a)

(b)

TERMINAL BLOCK

TECHNICAL FIELD

The present invention relates to a terminal block that holds a plurality of terminals.

The present application claims priority from Japanese Patent Application No. 2011-022956 filed on Feb. 4, 2011 and International Application PCT/JP2012/52411 filed on Feb. 2, 2012. The contents described and/or illustrated in the documents relevant to the Japanese Patent. Application No. 2011-022956 and International Application PCT/JP2012-52411 will be incorporated herein by reference as a part of the description and/or drawings of the present application.

BACKGROUND ART

A connector Ca is known in which a rear end portion 30R of a first terminal metal fitting 30 protrudes from a terminal holding portion 25 to the rear side so as to be exposed to the outside of a first housing 20, and a partition wall 26 protruding in a cantilever shape to the rear side is formed in the first housing 20 (for example, see Patent Literature 1).

In such a connector Ca, first terminal metal fittings 30 are separated from each other by a wall inside the terminal holding portion 25. Further, a partition wall 26 is interposed between the rear end portions 30R of the first terminal metal fittings 30 in order to secure a creepage distance of insulation between the first terminal metal fittings 30.

CITATION LIST

Patent Literature

Patent Literature 1: JP 2006-31962 A

DISCLOSURE OF THE INVENTION

Problem to be Solved by the Invention

In order to secure a creepage distance of insulation between terminals, the thickness of the partition wall needs to be a predetermined thickness or more. Accordingly, in a case where the size of the above-described connector is reduced, the external partition wall is thicker than the wall of the inside of the terminal holding portion, and there is a case where the partition wall protrude to the terminal insertion hole of the terminal holding portion.

Meanwhile, in order to equip the connector with waterproof performance and oil-proof performance, a terminal seal is attached to the terminal, and the terminal seal is pressed into the terminal holding portion together with the terminal. In such a case, when the insertion hole of the terminal holding portion is partially closed by the partition wall, it is difficult to press the terminal and the seal member into the terminal holding portion. Accordingly, there is a problem in that a sufficient reduction in the size of the housing cannot be achieved.

Means for Solving Problem

An object to be achieved by the present invention is to provide a terminal block capable of reducing the size of the housing.

[1] A terminal block according to the present invention comprises: a housing which holds a plurality of terminals so as to expose at least one end portion of each of the terminals; and a partition member which includes a partition wall dividing the exposed end portions of the plurality of the terminals, and the housing and the partition member are configured to be separate from each other.

[2] In the above-described invention, the terminal block may further comprise a nut or bolt, the partition member may include a holding portion holding the nut or the bolt, the housing may include an insertion portion into which the holding portion and a part of the nut or the bolt are inserted along an extending direction of the terminals, the holding portion may include a concave portion which holds the nut or bolt in the extending direction, and the insertion portion may include an engagement portion which is engaged with a part of the nut or the bolt in a direction which is substantially perpendicular to the extending direction.

[3] In the above-described invention, the partition member may further include a connection portion which connects a plurality of the partition walls.

Effect of the Invention

According to the present invention, the housing and the partition member are configured to be separate from each other, and accordingly, a reduction in the size of the housing can be achieved.

BRIEF DESCRIPTION OF DRAWINGS

FIG. 3(*b*) is a plan view that illustrates a male connector in an embodiment of the present invention. FIG. 3(*c*) is a side view of the male connector in this embodiment, and FIG. 3(*d*) is a rear view that illustrates the male connector in this embodiment:

FIG. 9(*b*) is a plan view that illustrates a female connector in an embodiment of the present invention, and FIG. 9(*c*) is a side view that illustrates a female connector in an embodiment of the present invention;

BEST MODE(S) FOR CARRYING OUT THE INVENTION

Hereinafter, embodiments of the present invention will be described with reference to the drawings.

Figure 1:
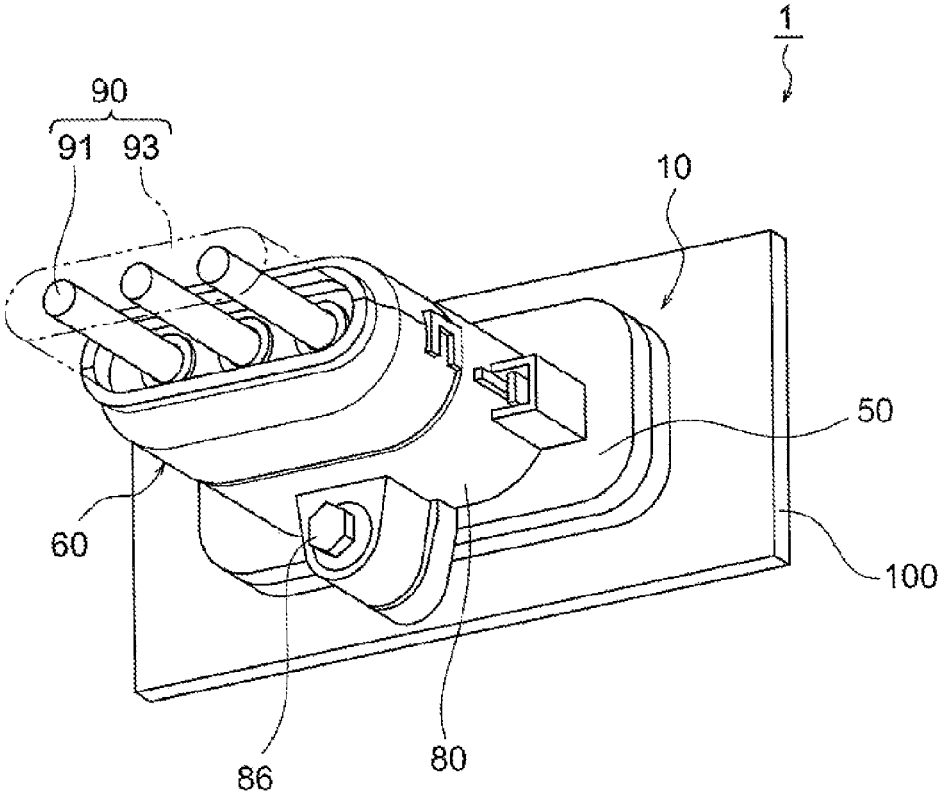
FIG. 1 is a perspective view that illustrates a connector assembly in an embodiment of the present invention and is a diagram that illustrates the connector assembly in a fitted state.
Figure 2:
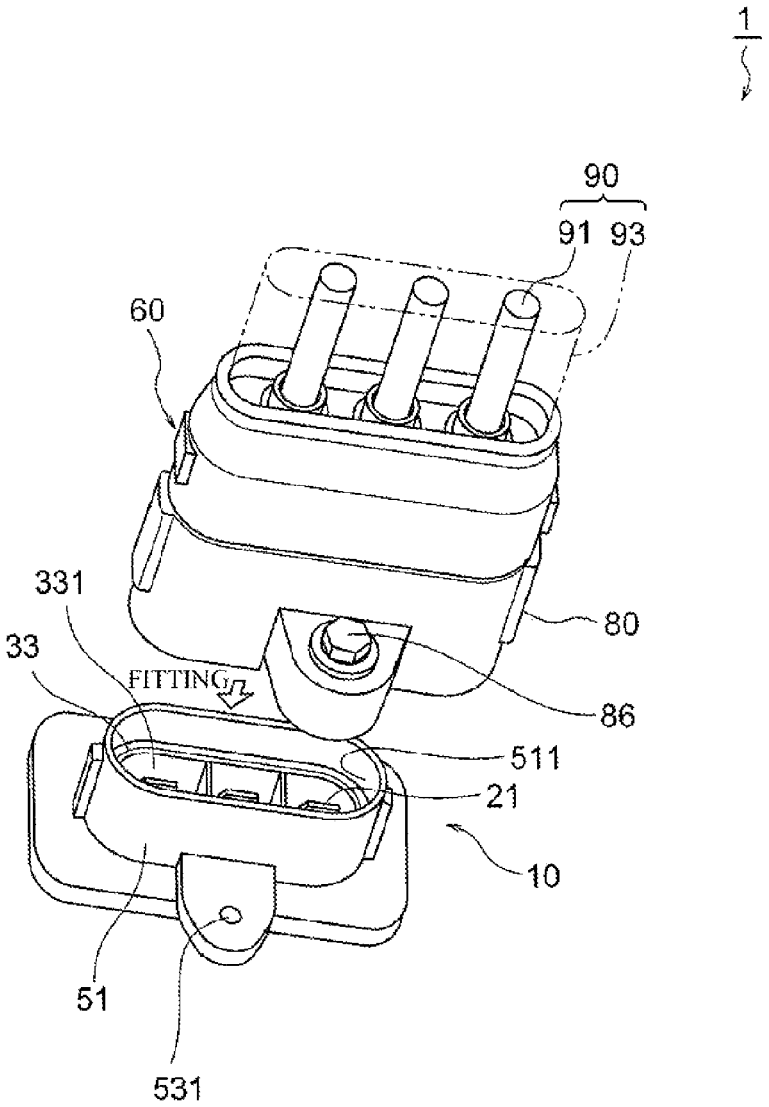
FIG. 2 is an exploded perspective view that illustrates the connector assembly in an embodiment of the present invention.

FIGS. 1 and 2 are diagrams that illustrate a connector assembly in this embodiment, FIG. 1 illustrates the connector assembly in a fitted state, and FIG. 2 illustrates the connector assembly before fitting.

The connector assembly 1 in this embodiment, as illustrated in FIGS. 1 and 2, comprises a male connector 10 and a female connector 60 that can be fitted together. For example, in an electric vehicle using an electric motor as a driving source, this connector assembly 1 is used as a connector of electric power cables transferring large-volume electric power between the electric motor and an inverter or between the inverter and a battery.

In this embodiment, the male connector 10, for example, is attached to a casing 100 of the electric motor. On the other hand, the female connector 60, for example, is attached to an end portion of an AC electric power cable 90 that is electrically connected to the inverter.

In this embodiment, the AC electric power cable 90 comprises three electric wires 91 for three-phase AC power (U, V, and W phases) and a braided wire 93 enclosing the three electric wires 91.

In this connector assembly 1, by screwing (threadably engaging) a bolt 86 provided in the female connector 60 into a female screw portion 531 of the male connector 10, the male connector 10 and the female connector 60 fit together, and the inverter and the electric motor are electrically connected to each other through the electric power cable 90.

Note that, for example, the connector assembly 1 in this embodiment may be used, for example, for connecting a electric power cable electrically connected to an electric motor to an inverter or may be used for electrically connecting an inverter and a battery to each other. Here, the above-described electric vehicle includes a hybrid electric vehicle that uses both an internal combustion engine and an electric motor as a driving source.

Hereinafter, a direction for fitting the male connector 10 and the female connector 60 together will be referred to as a "fitting direction", and a direction for separating the male connector 10 and the female connector 60 (in other words, a direction opposite to the fitting direction) will be referred to as a "releasing direction".

First, the configuration of the male connector 10 will be described in detail with reference to FIGS. 3 to 7.

Figure 3:
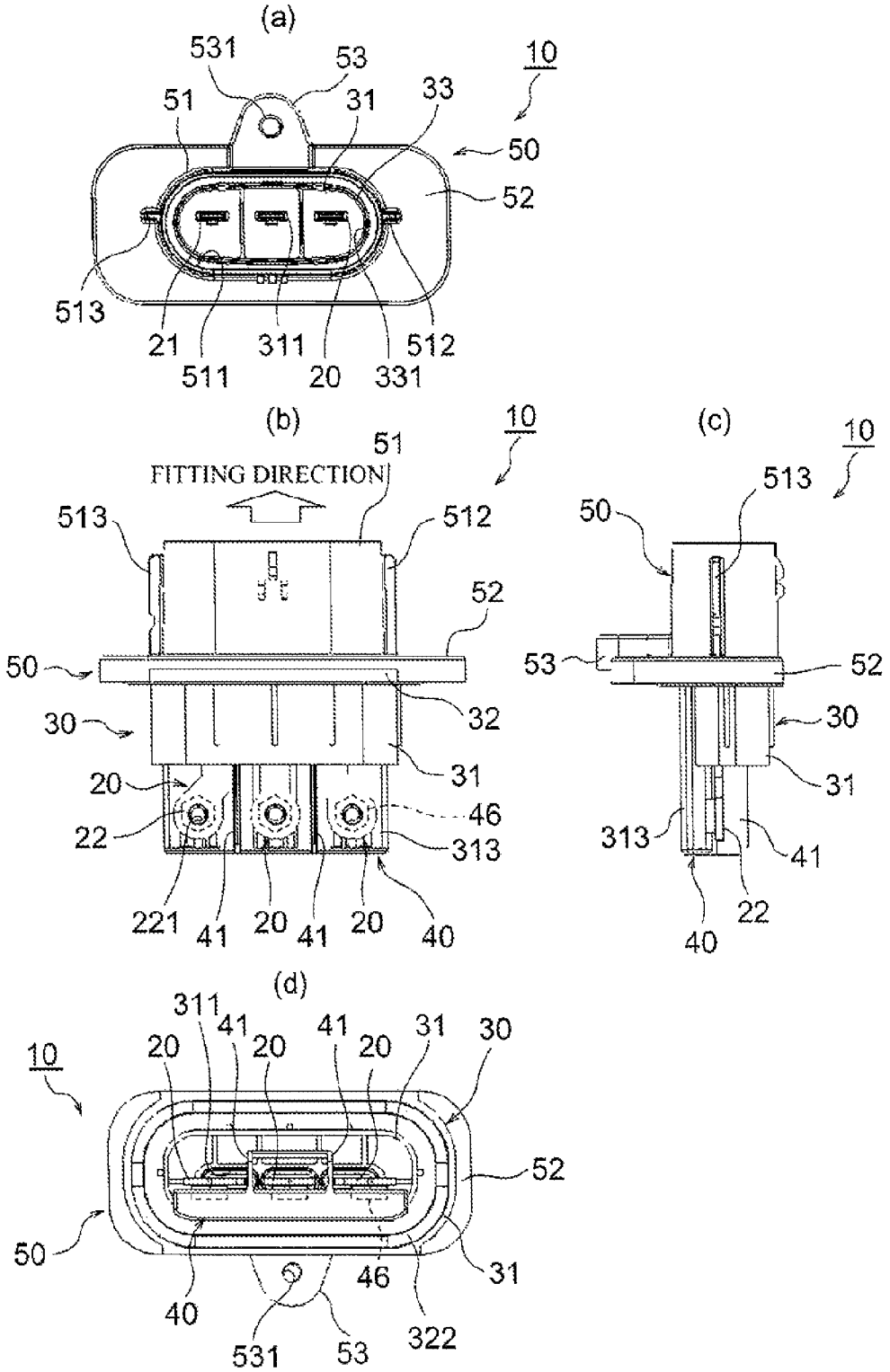
FIG. 3(*a*) is a front view that illustrates a male connector in an embodiment of the present invention.
Figure 4:
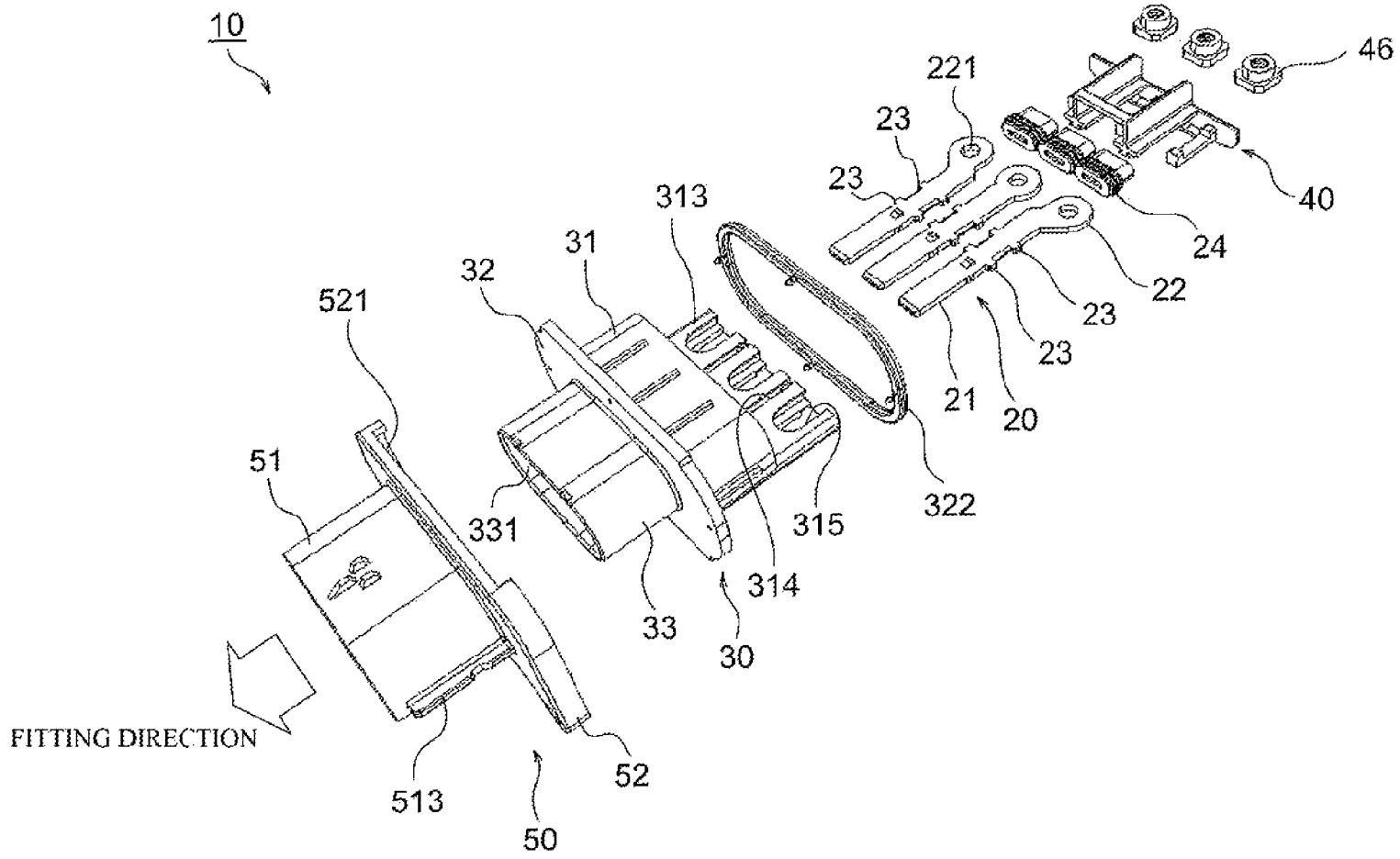
FIG. 4 is an exploded perspective view that illustrates a male connector in an embodiment of the present invention.
Figure 5:
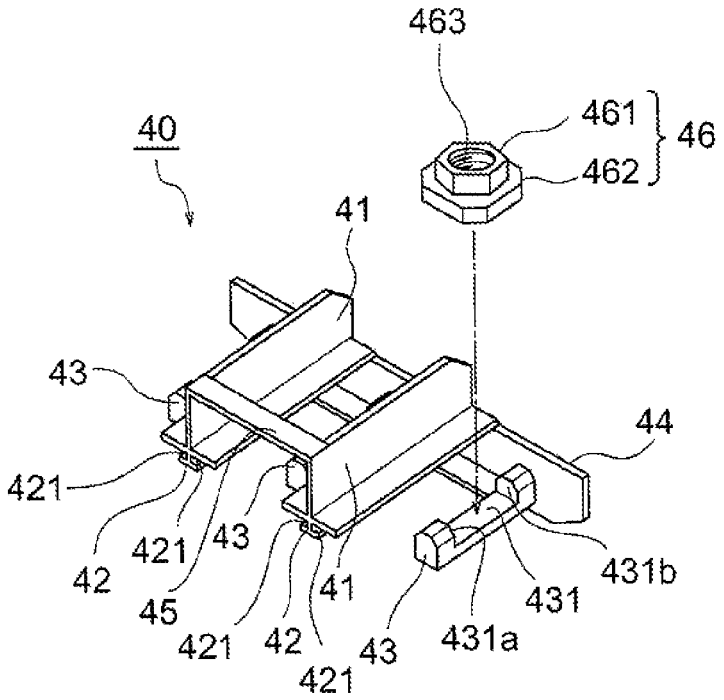
FIG. 5 is a perspective view that illustrates a partition member in an embodiment of the present invention.
Figure 6:
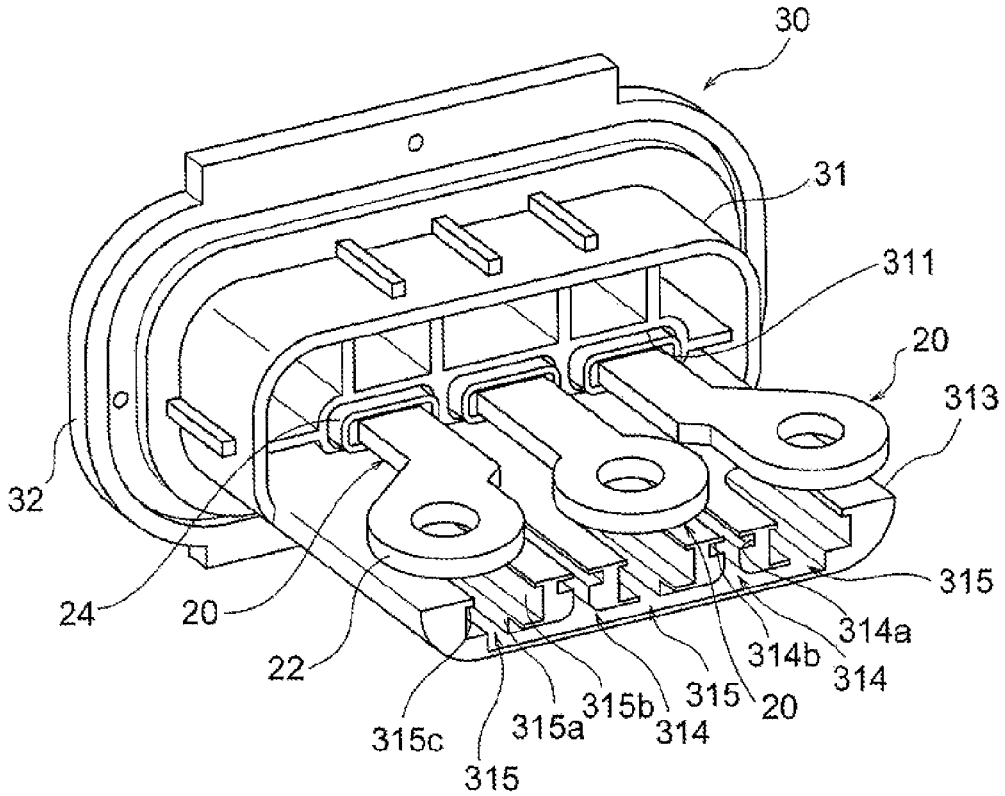
FIG. 6 is a perspective view that illustrates a male-side inner housing before the attachment of a partition member in an embodiment of the present invention.
Figure 7:
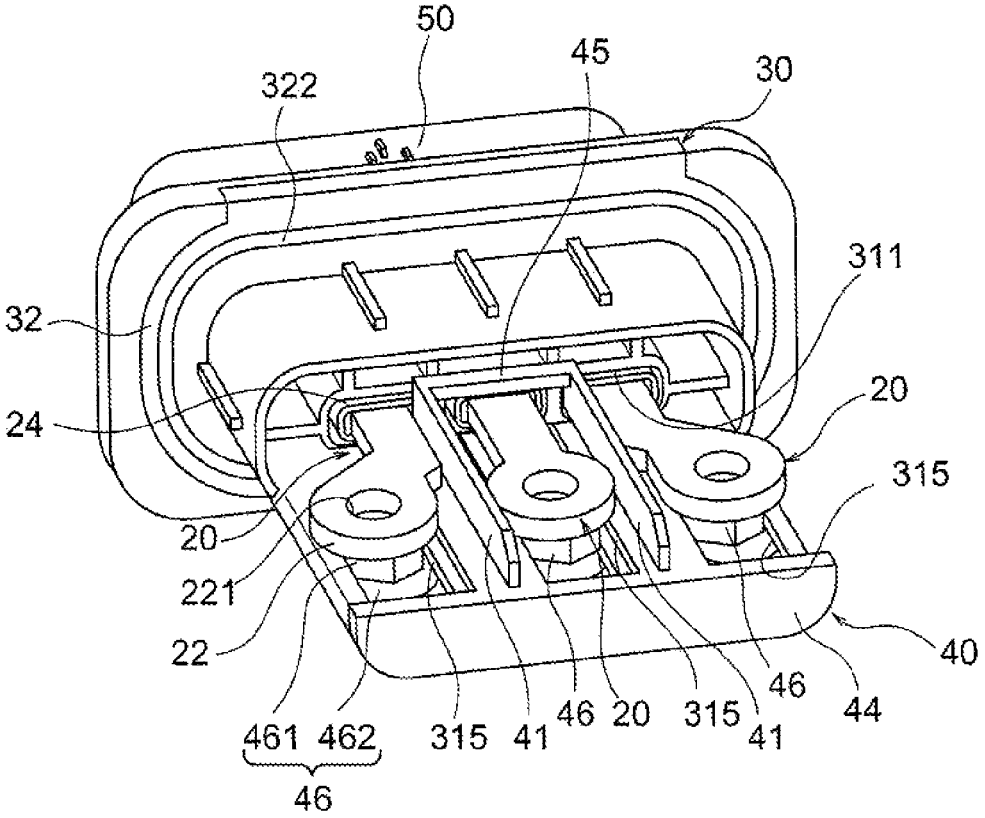
FIG. 7 is a perspective view that illustrates the male-side inner housing after the attachment of the partition member in an embodiment of the present invention.

FIGS. 3(*a*) to 3(*d*) are diagrams that illustrate the male connector in this embodiment, FIG. 4 is an exploded perspective view that illustrates the male connector in this embodiment, FIG. 5 is a perspective view that illustrates a partition member in this embodiment, FIG. 6 is a perspective view that illustrates a male-side inner housing before the attachment of a partition member in this embodiment, and FIG. 7 is a perspective view that illustrates the male-side inner housing after the attachment of the partition member in this embodiment.

The male connector 10 in this embodiment, as illustrated in FIGS. 3(*a*) to 3(*d*) and 4, comprises three male terminals 20, a male-side inner housing 30, a partition member 40, and a male-side outer housing 50.

The male terminal 20, for example, is made from copper or a copper alloy and, as illustrated in FIG. 4, includes a flat tab 21 at the front end thereof and includes a circular portion 22 (so-called an LA terminal) having an inner hole 221 at the rear end thereof. By inserting the tab 21 of the male terminal 20 into a housing portion 71 (see FIG. 11(*a*)) of the female terminal 70, the male terminal 20 and the female terminal 70 fit together.

As illustrated in FIGS. 3(*b*) and 3(*d*), on the lower side of the circular portion 22 of the male terminal 20, nuts 46 are held by the partition member 40. For example, by screwing a bolt (not illustrated in the figure) inserted into the inner hole 221 into the nut 46, a busbar (not illustrated in the figure) electrically connected to the electric motor is fastened to the male terminal 20, whereby the busbar and the male terminal 20 are electrically connected to each other.

Further, as illustrated in FIG. 4, two sets of protrusions 23 are formed in a middle portion of this male terminal 20. The male terminal 20 is inserted into a circular terminal seal 24 such that the terminal seal 24 is positioned between the protrusions 23 (see FIG. 8(*a*)), and the terminal seal 24 is held by the protrusions 23. The terminal seal 24, for example, is made from fluoride rubber.

The male-side inner housing 30, as illustrated in FIGS. 3(*a*) to 3(*d*) and 4, includes a terminal holding portion 31, an inner flange 32, and a male-side inner cylinder portion 33. The male-side inner housing 30, for example, is made from a material having electric insulation such as a resin material, and the terminal holding portion 31, the inner flange 32, and the male-side inner cylinder portion 33 are integrally formed.

In the terminal holding portion 31, three terminal holding holes 311 that holds the male terminals 20 are formed to be substantially parallel to each other. Each terminal holding hole 311 passes through the terminal holding portion 31, and the male terminal 20 is inserted into the inside of the terminal holding hole 311 from the tab 21 side through an opening disposed on the releasing direction side. Further, the terminal seal 24 is pressed into this terminal holding hole 311 together with the male terminal 20, and the terminal seal 24 seals between the male terminal 20 and the male-side inner housing 30.

The tab 21 of the male terminal 20 inserted into the terminal holding hole 311 protrudes from the opening of the terminal holding hole 311 that is disposed on the fitting-direction side and is positioned inside an inner hole 331 of the male-side inner cylinder portion 33.

On the other hand, the circular portion 22 of the male terminal 20 also protrudes from the opening of the terminal holding hole 311 that is disposed on the releasing-direction side, but the lower portion of the terminal holding portion 31 extends to the lower side of the circular portion 22 to configure an extending portion 313.

In this extending portion 313, an insertion groove 314 into which a first support arm 42 of the partition member 40 is inserted and a cutout 315 into which a second support arm 43 and a nut 46 are inserted are formed. Note that, the configuration of the extending portion 313 will be described later in detail together with the configuration of the partition member 40.

Figure 8:
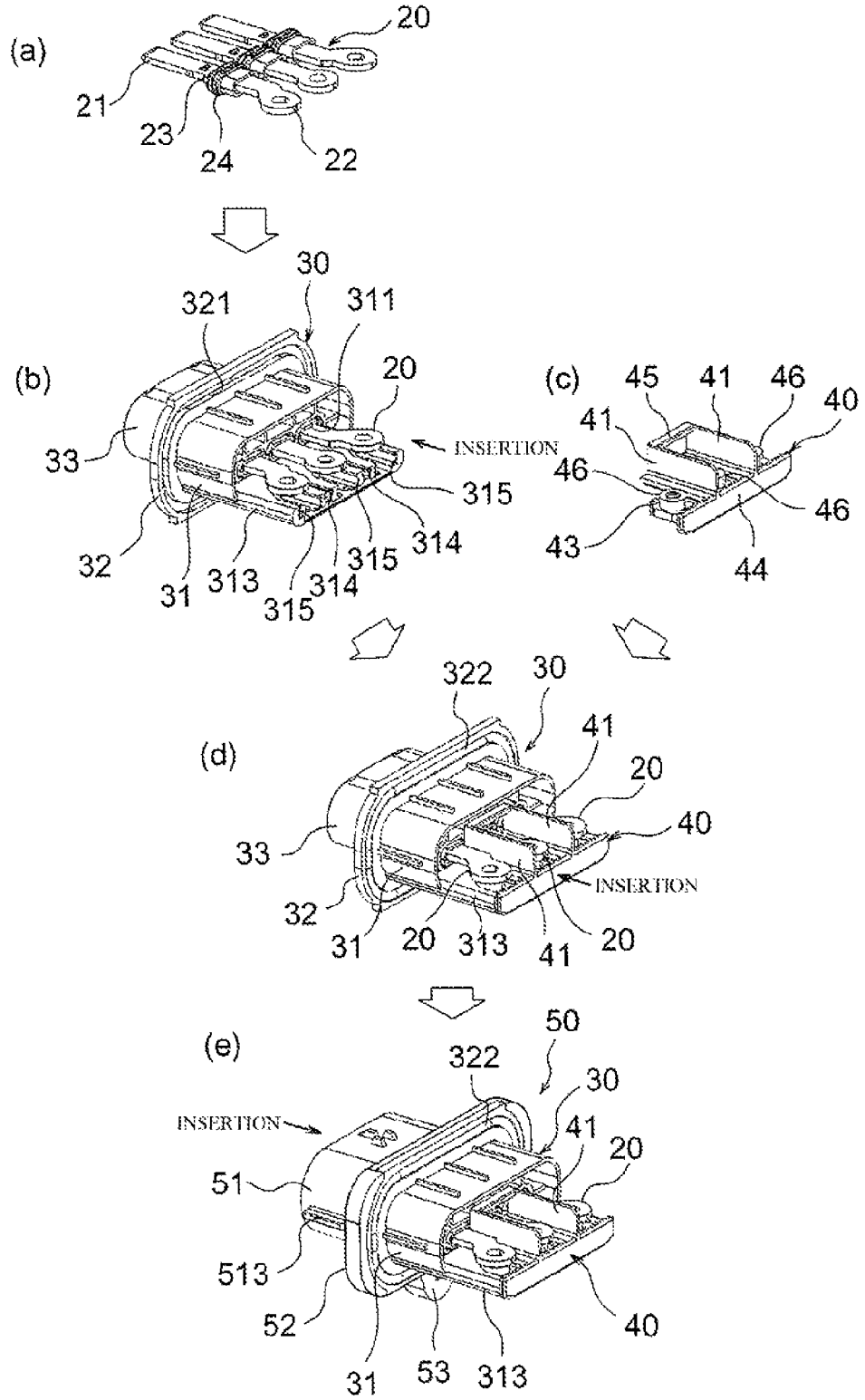
FIGS. 8(*a*) to 8(*e*) are diagrams that illustrate the sequence of assembly of a male connector in an embodiment of the present invention.

The inner flange 32 spreads from the terminal holding portion 31 in the diameter direction, and, on the principal face of the inner flange 32 that is disposed on the releasing-direction side, a circular groove 321 (see FIG. 8(*b*)) is formed so as to surround the terminal holding portion 31. A housing seal 322, for example, made from a fluororubber or the like is inserted in this circular groove 321.

The male-side inner cylinder portion 33 protrudes from the inner flange 32 toward the fitting direction. This male-side inner cylinder portion 33 is an approximately flat cylindrical body which has the inner hole 331, and the tab 21 of the male terminal 20 protruding from the terminal holding portion 31 is located in the inner hole 331.

The partition member 40, as illustrated in FIG. 5, includes two ribs 41, two first support arms 42, three second support arms 43, a first connection bar 44, and a second connection bar 45. This partition member 40, for example, is made from a material having electric insulation such as a resin material, and the rib 41, the first support arms 42, the second support arms 43, the first connection bar 44, and the second connection bar 45 are integrally formed.

The two ribs 41 are respectively supported by the first support arms 42. In each of the first support arms 42, an engagement groove 421 is formed in the longitudinal direction thereof.

Further, the two first support arms 42 are connected together at the releasing-direction side end portions via the first connection bar 44, and are connected together at the fitting-direction side end portions via the second connection bar 45.

The three second support arms 43 protrude from the first connection bar 44 in the fitting direction. These three second support arms 43 are arranged so as to correspond to the circular portions 22 of three male terminals 20 held by the male-side inner housing 30.

Further, a concave portion 431 that holds the nut 46 is formed in each second support arm 43. This concave portion 431 is defined by a first face 431*a* located on the fitting-direction side and a second face 431*b* located on the releasing-direction side.

The nut 46 includes a main body portion 461 having a hexagonal external shape and a pedestal portion 462 having an approximately rectangular external shape. By interposing the pedestal portion 462 between the first and second faces 431*a* and 431*b*, the nut 46 is fitted into the concave portion 431 of the second support arm 43.

Meanwhile, the insertion groove 314 of the extending portion 313 of the male-side inner housing 30, as illustrated in FIG. 6, includes a first arm inserting portion 314*a* into which the first support arm 42 is inserted and a first protruded portion 314*b* that protrudes to the upper side of the support arm inserting portion 314*a*.

Further, the cutout 315 of the extending portion 314 includes a second arm inserting portion 315*a* into which the second support arm 43 is inserted, a pedestal inserting portion 315*b* in which the pedestal portion 462 of the nut 46 is inserted, and a second protruded portion 315*c* that protrudes to the upper side of the pedestal inserting portion 315*b*.

The first support arm 42 of the partition member 40 is inserted into the insertion groove 314 of the extending portion 313, and the second support arm 43 of the partition member 40 and the nut 46 are inserted into the cutout 315 of the extending portion 313.

At this time, when the first support arm 42 is inserted into the insertion groove 314 of the extending portion 313, the protruded portion 314*c* of the insertion groove 314 is inserted into the engagement groove 421 of the first support arm 42, and the protruded portion 314*c* of the insertion groove 314 and the first support arm 42 are engaged with each other in the vertical direction (a direction that is substantially perpendicular to the fitting direction).

Further, when the second support arm 43 is inserted into the cutout 315 of the extending portion 313, the protruded portion 315*b* of the cutout 315 protrudes to the upper side of the pedestal portion 462 of the nut 46, and the protruded portion 315*b* of the cutout 315 and the pedestal 462 are engaged with each other in the vertical direction.

The detachment of the partition member 40 from the extending portion 313 to the upper side is prevented by the engagement described above.

When the partition member 40 is inserted into the male-side inner housing 30 as above, as illustrated in FIG. 7, the rib 41 is interposed as a partition wall between rear portions of the mail terminal 20 which are exposed from the mail-side inner housing 30 and include the circular portions 22, whereby a creepage distance of insulation between the male terminals 20 is secured.

Further, when the partition member 40 is inserted into the male-side inner housing 30, the nut 46 is located on the lower side of the circular portion 22 of the male terminal 20, and hole 221 of the circular portion 22 and the screw hole 463 of the nut 46 are arranged coaxially. In this state, when the circular portion of the male terminal 20 and the busbar are fastened by the bolt and the nut 46, the whole partition member 40 including the nut 46 is fixed to the male-side inner housing 30 though the male terminal 20 and the bolt. Accordingly, the detachment of the partition member 40 from the extending portion 313 in the fitting direction is prevented.

The male-side outer housing 50, as illustrated in FIGS. 3(*a*) to 3(*d*) and 4, includes a male-side outer cylinder portion 51, an outer flange 52 and a male-side convex portion 53. This male-side outer housing 50, for example, is made from a material having conductivity such as aluminum, and the male-side outer cylinder portion 51, the outer flange 52, and the male-side convex portion 53 are integrally formed.

The male-side outer cylinder portion 51 is an approximately flat cylindrical body which has the inner hole 511, and the male-side inner cylinder portion 33 is inserted in the inner hole 511. Further, at both ends of the male-side outer cylinder portion 51 in the major axis direction, guide ribs 512 and 513 are formed along the fitting direction. When the male connector 10 and the female connector 60 fit together, by guiding the guide ribs 512 and 513 into guide grooves 822 and 823 (see FIG. 9(*a*)) of the female connector 60, the female connector 60 is precisely positioned with respect to the male connector 10.

The outer flange 52 is provided on the releasing-direction side end portion of the male-side outer cylinder portion 51. As illustrated in FIG. 4, a concave portion 521 corresponding to the inner flange 32 of the male-side inner housing 30 is formed in the outer flange 52, and the inner flange 32 is fitted into the concave portion 521. This outer flange 52 is fastened to the casing 100 of the electric motor by using a bolt or the like.

The male-side convex portion 53 protrudes from the male-side outer cylinder portion 51 in the diameter direction. As illustrated in FIGS. 3(*a*) and 3(*d*), a female screw portion 531 that can be screwed with the bolt 86 of the female connector 60 is provided in the approximate center of the male-side convex portion 53.

Hereinafter, the sequence of assembly of the male connector 60 will be described with reference to FIGS. 8(*a*) to 8(*e*). FIGS. 8(*a*) to 8(*e*) are diagrams that illustrate the sequence of assembly of the male connector in this embodiment.

First, as illustrated in FIG. 8(*a*), the male terminal 20 is inserted into the terminal seal 24, and the terminal seal 24 is positioned between the protrusions 23. Subsequently, as illustrated in FIG. 8(*b*), the male terminal 20 is inserted into the terminal holding hole 311 of the male-side inner housing 30.

Meanwhile, as illustrated in FIG. 8(*c*), nuts 46 are fitted into concave portions 431 of the second support arm 43 of the partition member 40.

Subsequently, as illustrated in FIG. 8(*d*), the first support arm 52 of the partition member 40 is inserted into the insertion groove 314 of the male-side inner housing 30, and, the second support arm 43 of the partition member 40 and nuts 46 are inserted into the cutout 315 of the male-side inner housing 30, whereby the partition member 40 is assembled into the male-side inner housing 30. Further, the housing seal 36 is fitted into the circular groove 34 of the male housing 20.

Subsequently, as illustrated in FIG. 8(*e*), the male-side inner cylinder portion 33 is inserted into the male-side outer cylinder portion 42, and the inner flange 32 is fitted into the concave portion 521 of the outer flange 52, and the male-side inner housing 30 is assembled into the male-side outer housing 50, whereby the male connector 10 is completed.

Next, the configuration of the female connector 60 will be described in detail with reference to FIGS. 9 to 11.

Figure 9:
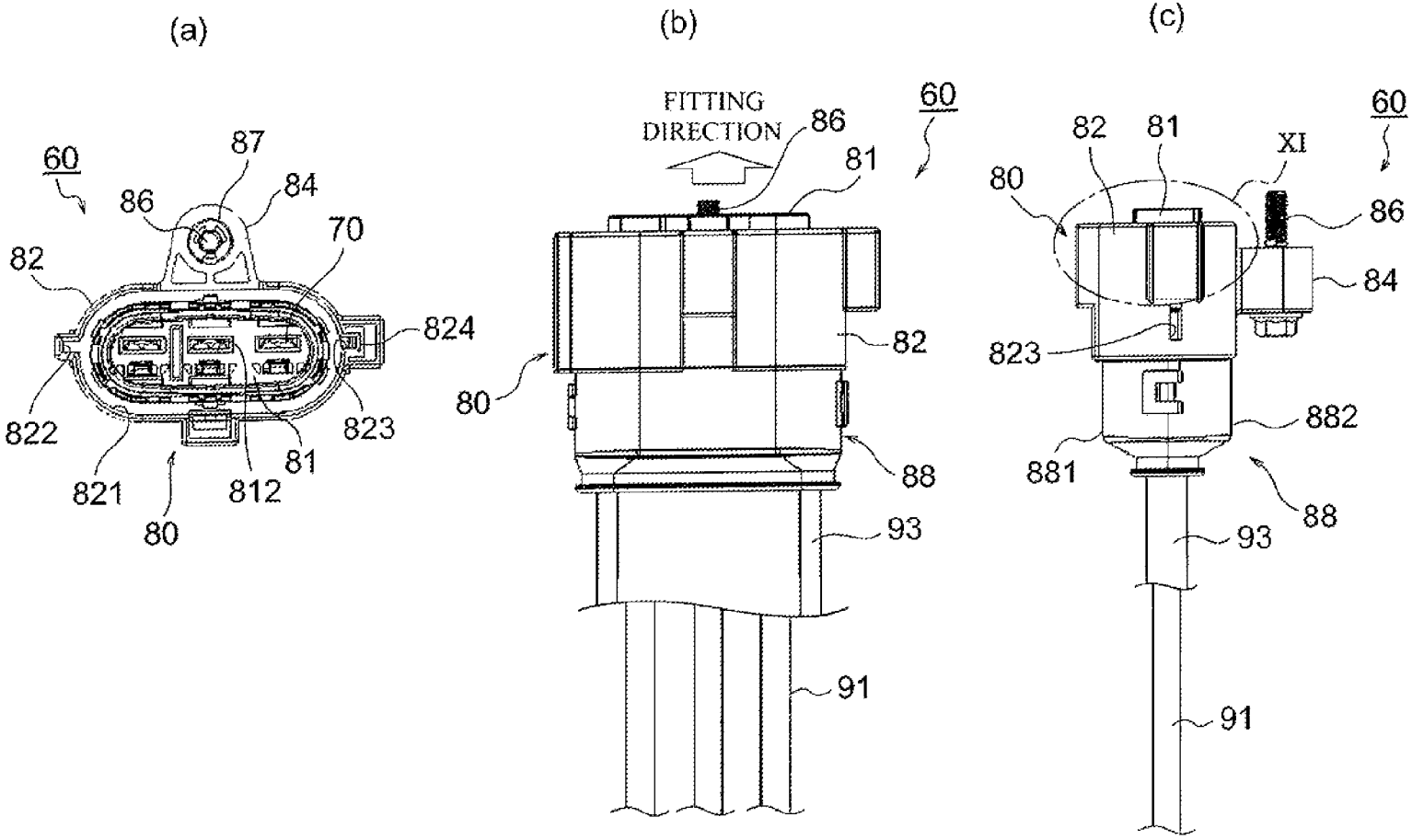
FIG. 9(*a*) is a front view that illustrates a female connector in an embodiment of the present invention.
Figure 10:
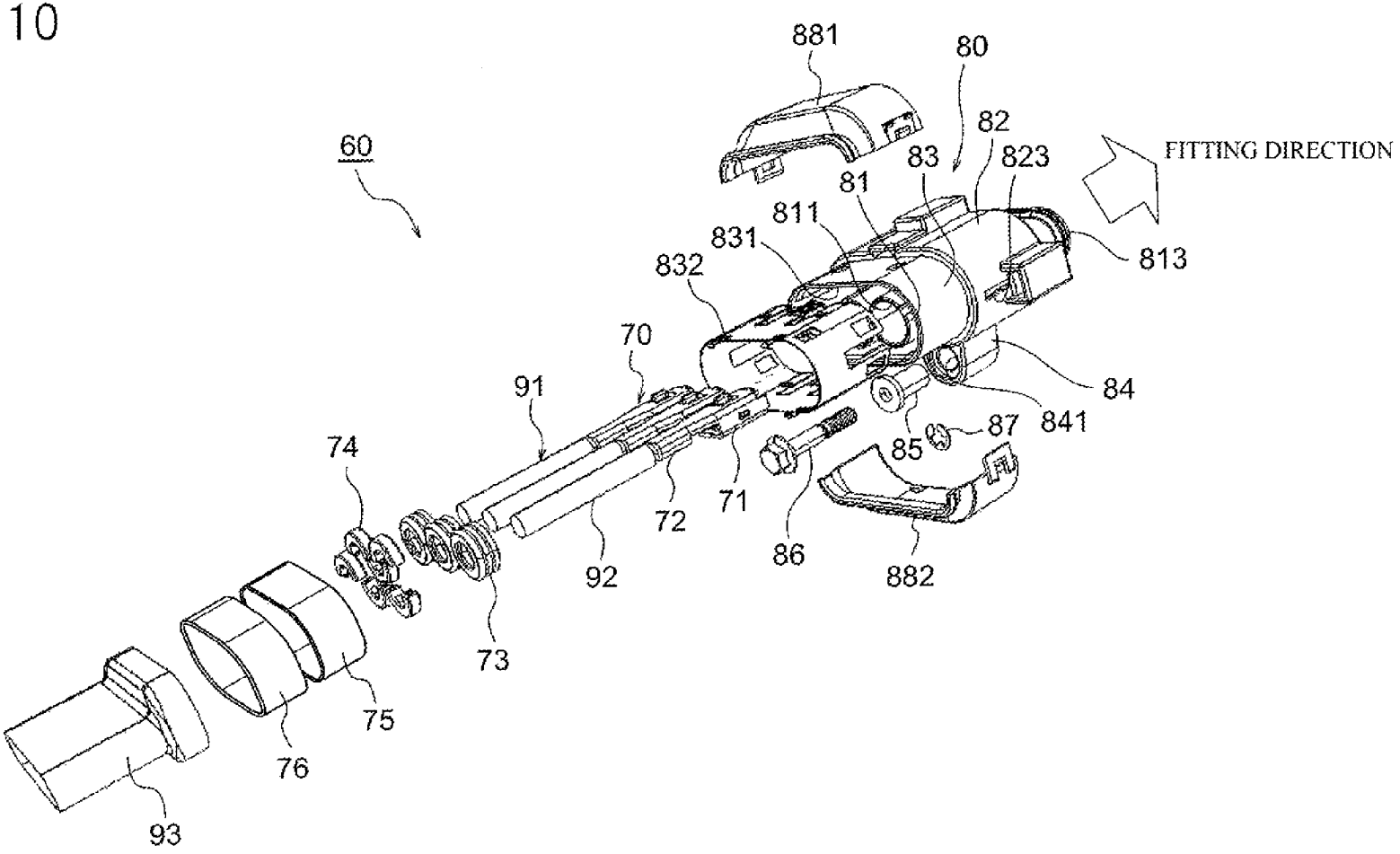
FIG. 10 is an exploded perspective view that illustrates a female connector in an embodiment of the present invention.
Figure 11:
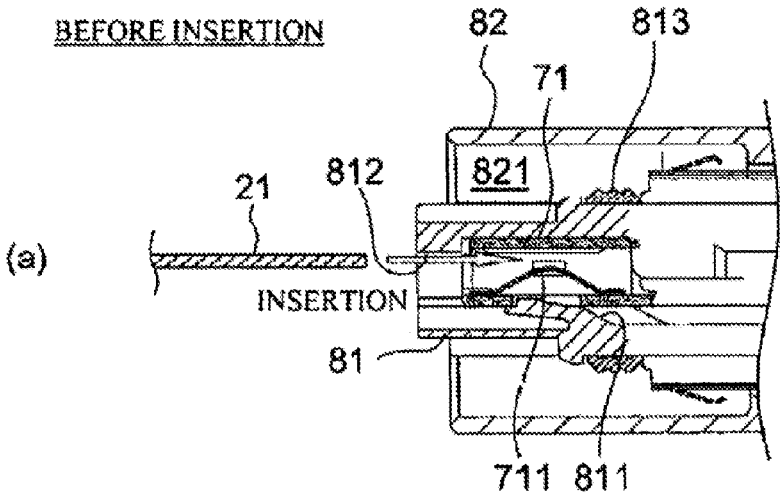
FIGS. 11(*a*) and 11(*b*) are enlarged cross-sectional views of a portion XI illustrated in FIG. 9(*c*), FIG. 11(*a*) illustrates a state before fitting a male terminal into a female terminal, and FIG. 11(*b*) illustrates a state in which the male terminal and the female terminal are fitted together.
Figure 11:
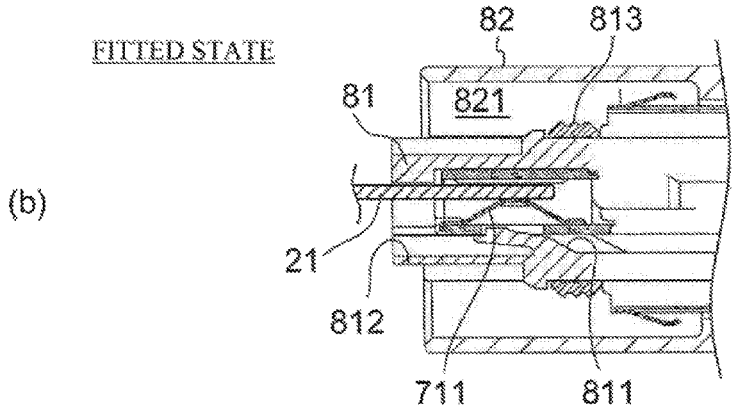

FIGS. 9(*a*) to 9(*c*) are diagrams that illustrate the female connector in this embodiment, FIG. 10 is an exploded perspective view of the female connector in this embodiment, and FIGS. 11(*a*) and 11(*b*) are enlarged cross-sectional views of a portion XI illustrated in FIG. 9(*c*).

The female connector 60 in this embodiment, as illustrated in FIGS. 9(*a*) to 9(*c*) and 10, includes three female terminals 70 and a female-side housing 80.

The female terminal 70, for example, is made from copper or a copper alloy and, as illustrated in FIG. 10, includes an approximate box-shaped housing portion 71 at the front end side thereof and includes a barrel portion 72 at the rear end thereof.

As illustrated in FIG. 11(*a*), a flat spring member 711 bent in an arch shape is provided inside the housing portion 71 of the female terminal 70. The tab 21 of the male terminal 20 can be inserted into this housing portion 71, and the tab 21 inserted into the inside of the housing portion 71 is pressed to the inner wall face of the box-shaped housing portion 71 by the flat spring member 711. Accordingly, the tab 21 is inserted into the inside of the housing portion 71 while being pressed by the flat spring member 711. In accordance with the pressing, wiping is performed for the tab 21 and the housing portion 71 with each other, and an oxide film formed on the surface of the tab 21 and the housing portion 71 is removed. Then, as illustrated in FIG. 11(*b*), when the tab 21 inserted into the housing portion 71 arrives at a regular position, the male terminal 20 and the female terminal 70 are completely fitted together.

As illustrated in FIG. 10, a center conductor of the electric wire 91 of the electric power cable 90 is crimped to the barrel portion 72 of the female terminal 70. Note that while this electric wire 91 includes an insulating layer 92 covering the outer circumference of the center conductor, the coated layer 92 is peeled off and the center conductor is exposed at the end portion that is crimped to the barrel portion 72.

This electric wire 91 is inserted into a circular wire seal 73. Further, a strain reef 74 is attached to the electric wire 91 near the wire seal 73, and the detachment of the wire seal 74 is prevented. Note that, for example, the wire seal 73 is made from silicone rubber, and the strain reef 74, for example, is made from polybutylene terephthalate (PBT).

The female-side housing 80, as illustrated in FIGS. 9(*a*) to 9(*c*) and 10, includes a terminal housing portion 81, a female-side cylinder portion 82, an outer wall portion 83, and a female-side convex portion 84. This female-side inner housing 80, for example, is made from a material having electric insulation such as a resin material.

In the terminal housing portion 81, three terminal housing holes 811 each housing the female terminals 70 are formed to be substantially parallel to each other. Each terminal housing hole 811 is open on the releasing-direction side, and the female terminal 70 is inserted into the inside of the terminal housing hole 811 from the housing portion 71 side through the opening portion. A wire seal 73 is pressed into the terminal housing hole 811 together with the female terminal 70, and the wire seal 73 seals between the female terminal 70 and the female-side housing 80.

As illustrated in FIG. 9(*a*), a terminal exposing hole 812 is formed at the bottom of the terminal housing hole 811, and the tab 21 of the male terminal 20 can approach the female terminal 70 housed inside the terminal housing hole 811 through the terminal exposing hole 812.

This terminal housing portion 81 protrudes to the inside of the female-side cylinder portion 82, and a fitting groove 821 is formed between the terminal housing portion 81 and the female-side cylinder portion 82. The male-side inner cylinder portion 33 and the male-side outer cylinder portion 51 of the male connector 10 are inserted into this fitting groove 821, and the terminal housing portion 81 is inserted into the inside of the male-side inner cylinder portion 33 and the male-side outer cylinder portion 51, whereby the male connector 10 and the female connector 60 fit together.

Further, in the fitting groove 821, a circular housing seal 813 is installed to the outer periphery of the terminal housing portion 81. This housing seal 813, for example, is made from silicone rubber and seals between the male-side inner cylinder portion 33 and the terminal housing portion 81 at the time of fitting.

The female-side cylinder portion 82, as illustrated in FIG. 9(*a*), is an approximately flat cylindrical body, and guide grooves 822 and 823 are formed along the fitting direction at both ends of the female-side cylinder portion 82 in the major axis direction. By inserting the guide ribs 512 and 513 of the male connector 10 into the guide grooves 822 and 823, the female connector 60 is precisely positioned with respect to the male connector 10.

The outer wall portion 83, as illustrated in FIG. 10, surrounds the periphery of the terminal housing portion 81 on the releasing-direction side. An approximately flat cylindrical shield plate 832 is inserted in an insertion space 831 formed between the outer wall portion 83 and the terminal housing portion 81. This shield plate 832, for example, is made from copper or a copper alloy and electromagnetically shields the female terminal 70 in the female-side housing 80.

Further, the braided wire 93 of the electric power cable 90 and two ferrules 75 and 76 that sandwich an end portion of the braided wire 93 and are crimped are inserted in this insertion space 831. Accordingly, the shield plate 832 and the braided wire 93 are electrically connected to each other through the outer ferrule 75. Then, in the state where the braided wire 93, the ferrules 75 and 76, and the shield plate 832 are inserted into the insertion space 831, the outer wall portion 83 is covered with a rear cover 88 that is configured by an upper cover 881 and a lower cover 882.

The female-side convex portion 84 protrudes from the female-side cylinder portion 82 in the diameter direction at a position corresponding to the male-side convex portion 53. A through hole 841 which passes through the female-side convex portion 84 in the fitting direction is formed in this female-side convex portion 84. A collar 85, for example, made of steel is inserted in this through hole 841, and the bolt 86 is further inserted into the collar 85. The bolt 86 is prevented from detaching on the face of the female-side convex portion 84 that is located on the fitting-direction side by using an E ring 87 and is held to be rotatable by the female-side housing 80.

Figure 12:
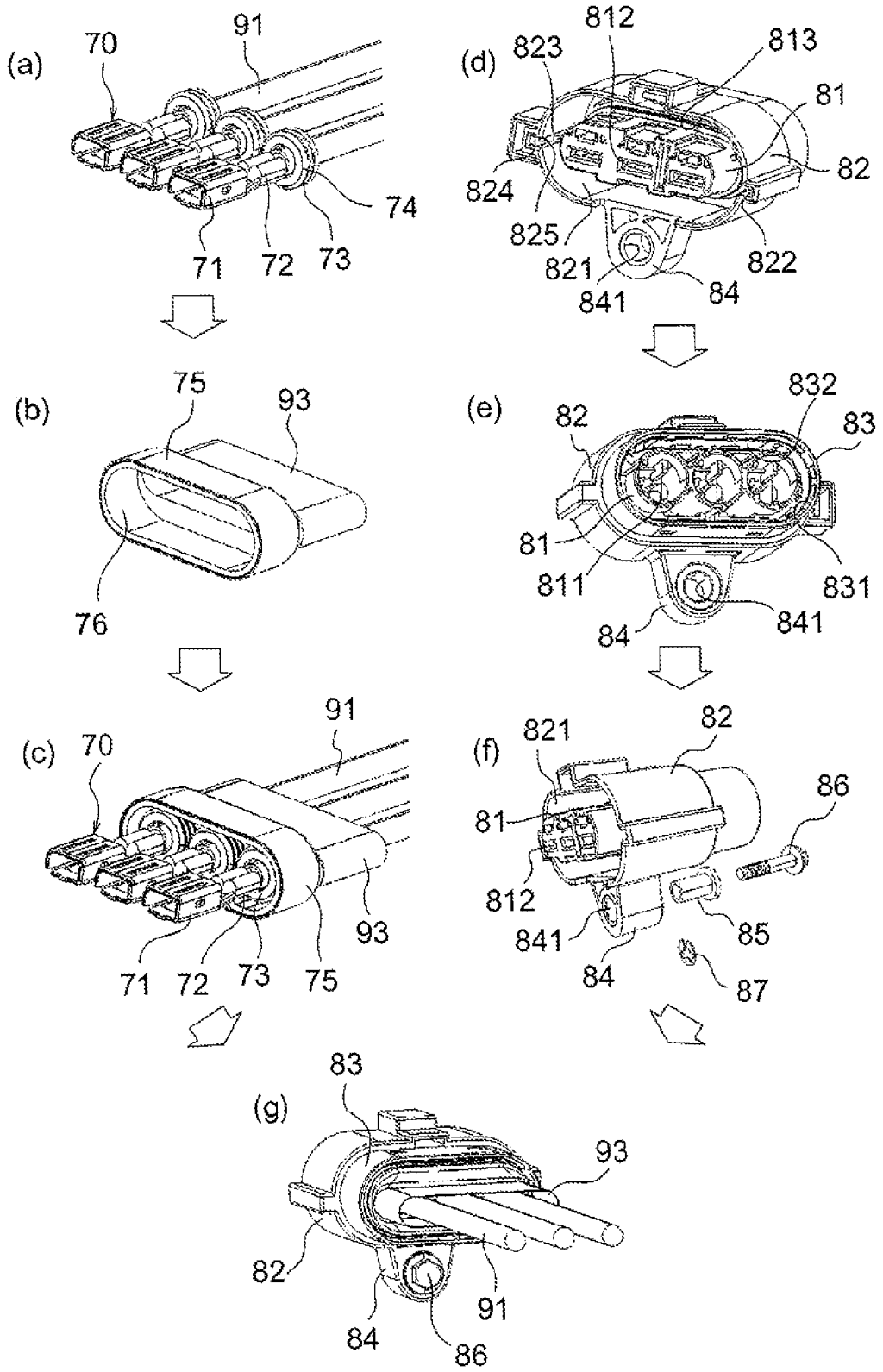
FIGS. 12(*a*) to 12(*g*) illustrate the sequence of assembly of a female connector in an embodiment of the present invention.

Hereinafter, the sequence of assembly of the female connector 60 will be described with reference to FIGS. 12(*a*) to 12(*g*). FIGS. 12(*a*) to 12(*g*) are diagrams that illustrate the sequence of assembly of the female connector in this embodiment.

First, as illustrated in FIG. 12(*a*), the electric wire 91 is inserted into the wire seal 73, and the strain reef 74 is installed to the electric wire 91. Subsequently, the center conductor exposed from the insulating layer 92 at the end portion of the electric wire 91 and the barrel portion 72 of the female terminal 70 are caulked (crimped) each other.

Meanwhile, as illustrated in FIG. 12(*b*), the end portion of the braided wire 93 is inserted into the inside of the outer ferrule 75, the inner ferrule 76 is inserted into the inside of the end portion of the braided wire 93, the end portion of the braided wire 93 is interposed between the outer ferrule 75 and the inner ferrule 76, and the outer ferrule 75, the braided wire 93, and the inner ferrule 76 are caulked (crimped) each other.

Subsequently, as illustrated in FIG. 12(*c*), the electric wire 91 to which the female terminal 70 is attached is inserted into the inside of the braided wire 93.

Meanwhile, as illustrated in FIG. 2(*d*), the housing seal 813 is inserted into the fitting groove 821 of the female-side housing 80, and the housing seal 813 is installed to the periphery of the terminal housing portion 81. Subsequently, as illustrated in FIG. 12(*e*), the shield plate 832 is inserted into the insertion space 831 of the female-side housing 80. Subsequently, as illustrated in FIG. 12(*f*), the collar 85 and the bolt 86 are inserted into the through hole 841 of the female-side convex portion 84 of the female-side housing 80, and the bolt 86 is further fixed by the E ring 87.

Subsequently, as illustrated in FIG. 12(*g*), the female terminal 70 is inserted into the inside of the terminal housing hole 811 of the female-side housing 80, and the outer ferrule 75, the braided wire 93, and the inner ferrule 76 are inserted into the inside of the housing space 831 of the female-side housing 80.

Subsequently, although not particularly illustrated in the figure, by installing the rear cover 88 to the female-side housing 80 so as to cover the outer wall portion 83 of the female-side housing 80 and the braided wire 93, the female connector 60 is completed.

The male connector 10 and the female connector 60 described above are fitted together as below.

First, the male connector 10 and the female connector 60 are provisionally fitted together. Thereby, the male-side inner cylinder portion 33 and the male-side outer cylinder portion 51 of the male connector 10 are inserted into the inside of the fitting groove 821 of the female connector 60, and the terminal housing portion 81 of the female connector 60 is inserted into the inside of the male-side inner cylinder portion 33 and the male-side outer cylinder portion 51 of the male connector 10.

At this time, the guide ribs 512 and 513 of the male connector 10 are inserted into the concave portions 822 and 823 of the female connector 60. Further, the front end of the male screw portion of the bolt 86 of the female connector 60 is engaged into the female screw portion 531 of the male connector 10, and the bolt 86 can be screwed into the female screw portion 531.

From the state, when the bolt 86 is screwed into the female screw portion 531 by rotating the bolt 86, the female connector 60 approaches the male connector 10 while being guided by the guide ribs 512 and 513 and the concave portions 822 and 823, and, finally, the male connector 10 and the female connector 60 are fitted together.

As above, in this embodiment, the male-side inner housing 30 and the partition member 40 are configured to be separate from each other. Accordingly, the size of the male-side inner housing 30 can be reduced up to a degree where the rib cannot stand between the terminal holding holes 311 of the terminal holding portion 31. Particularly, in this embodiment, while the thickness of the rib 41 dividing the rear end portions exposed in the male terminal 20 is sufficient, the wall between the terminal holding holes 311 in the male-side inner housing 30 can be configured to be thin.

Further, in this embodiment, the nut 46 is sandwiched by the concave portion 431 of the second support arm 43 of the partition member 40, and the protruded portion 315*c* of the cutout 315 of the male-side inner housing 30 is engaged with the pedestal portion 462 of the nut 46.

Accordingly, when the bolt is screwed into the nut 46 through the hole 221 of the circular portion 22 of the male terminal 20, the partition member 40 is fixed to the male-side inner housing 30.

In addition, in this embodiment, the ribs 41 of the partition member 40 are connected together via the first and second connection bars 44 and 45. Accordingly, the partition member 40 can be easily inserted into the male-side inner housing 30, and the strength of the ribs 41 is improved.

Second Embodiment

Figure 13:
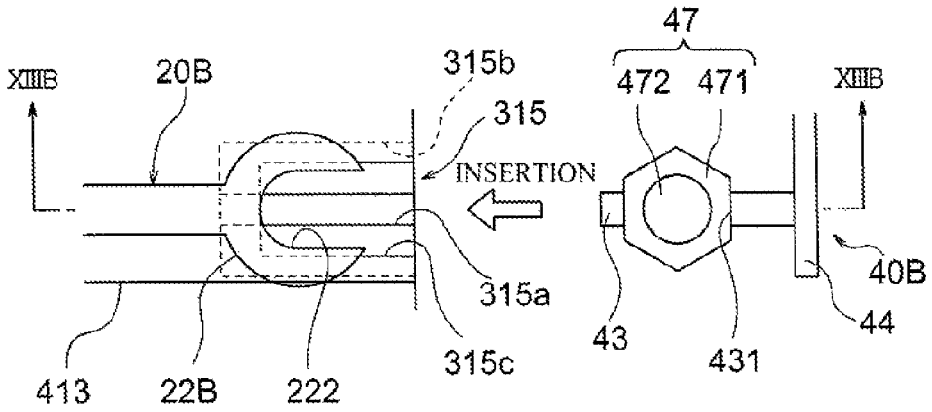
FIG. 13(*a*) is a plan view that illustrates a male terminal and a partition member in a second embodiment of the present invention, and FIG. 13(*b*) is a cross-sectional view taken along line illustrated in FIG. 13(*a*).
Figure 13:
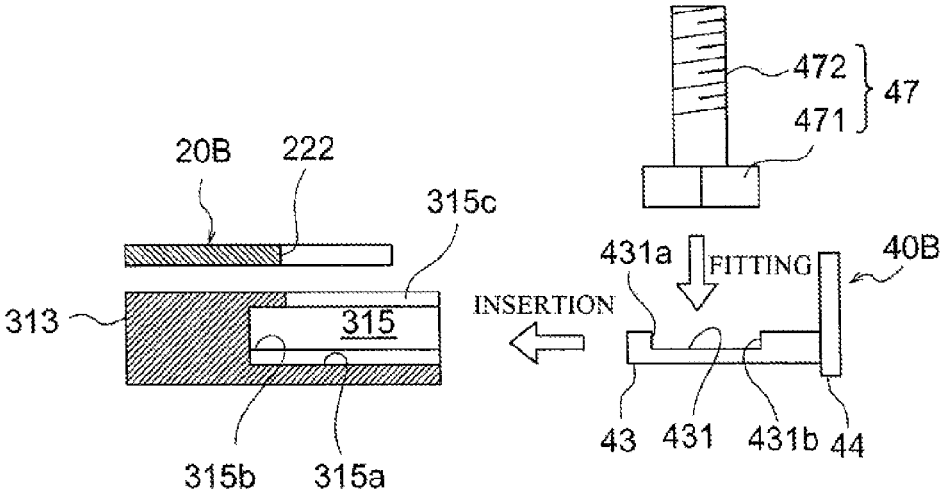

FIGS. 13(*a*) and 13(*b*) are diagrams that illustrate a second embodiment of the present invention.

In this embodiment, although a configuration in which a bolt 47 is used instead of the nut 46 and the structure of the end portion of the male terminal that is located on the releasing-direction side are different from those of the first embodiment, the other configurations are the same as those of the first embodiment. Hereinafter, in this embodiment, only differences from the first embodiment will be described, the same reference numeral is assigned to a part that is the same configuration as that of the first embodiment, and description thereof will not be presented.

As illustrated in FIGS. 13(*a*) and 13(*b*), a second support arm 43 of a partition member 40 supports a bolt 47, and a head portion 471 of the bolt 47 is fitted into a concave portion 431 of a second support arm 43.

Further, in this embodiment, a male terminal 20B includes a U-shaped portion 22B (so-called a hoe-type terminal) instead of the circular portion 22 at the rear end thereof. A screw portion 472 of the bolt 47 can be inserted into the U-shaped portion 22B.

In this embodiment, when the partition member 40 is attached to the male-side inner housing 30, the head portion 471 of the bolt 47 is inserted into a cutout 315 of an extending portion 313 together with the second support arm 43. At this time, a protruded portion 315*c* of the cutout portion 315 protrudes to the upper side of the head portion 471 of the bolt 47. Accordingly, the detachment of the partition member 40 from the extending portion 313 to the upper side is prevented.

In addition, when the partition member 40B is attached to the male-side inner housing 30, the screw portion 472 of the bolt 47 is positioned inside a slit 222 of the male terminal 20B. In this state, when the U-shaped portion 22B of the male terminal 20 and a busbar are fastened by the bolt 47 and a nut (not illustrated in the figure), the whole partition member 40B including the bolt 47 is fixed to the male-side inner housing 30 through the male terminal 20B and the nut. Accordingly, the detachment of the partition member 40B from the extending portion 313 in the fitting direction is prevented.

As described above, in this embodiment, similarly to the first embodiment, the male-side inner housing 30 and the partition member 40B are configured to be separate from each other. Accordingly, the size of the male-side inner housing 30 can be reduced up to a degree where the rib cannot stand between the terminal holding holes 311 of the terminal holding portion 31. Particularly, in this embodiment, while the thickness of the rib 41 dividing the rear end portions exposed in the male terminal 20 is sufficient, the wall between the terminal holding holes 311 in the male-side inner housing 30 can be configured to be thin.

Further, in this embodiment, the head portion 471 of the bolt 47 is sandwiched by the concave portion 431 of the second support arm 43 of the partition member 40B, and the protruded portion 315*c* of the cutout 315 of the male-side inner housing 30 is engaged with the head portion 471 of the bolt 47.

Accordingly, when the nut is screwed into the screw portion 472 of the bolt 47 inserted into the slit 222 of the U-shaped portion 22B of the male terminal 20B, the partition member 40B is fixed to the male-side inner housing 30.

In addition, in this embodiment, the ribs 41 of the partition member 40B are connected together via the first and second connection bars 44 and 45. Accordingly, the partition member 40 can be easily inserted into the male-side inner housing 30, and the strength of the ribs 41 is improved.

Note that, the male connectors 10 in the above-described first and second embodiments are equivalent to an example of a terminal block in the present invention, the male terminals 20 and 20B in the first and second embodiments are equivalent to an example of a terminal in the present invention, the male-side inner housings 30 in the first and second embodiments are equivalent to an example of a housing in the present invention, the second support arm 43 in this embodiment is equivalent to an example of a holding portion in the present invention, the cutout 315 in this embodiment, is equivalent to an example of an insertion portion in the present invention, the protruded portion 315*c* in this embodiment is equivalent to an example of an engagement portion in the present invention, and the fitting direction the releasing direction in this embodiment is equivalent to an example of an extending direction in the present invention.

The embodiments described above have been described for easy understanding of the present invention and not for purposes of limitation of the present invention. Thus, each element disclosed in the above-described embodiments is with intent to include all changes in the design and equivalents thereof belonging to the technical scope of the present invention.

For example, in the above-described embodiments, while an example has been described in which the present invention is applied to the male connector 10 holding the male terminal 20, in the present invention, the terminal block is not particularly limited thereto, as long as it holds the terminal.

EXPLANATIONS OF LETTERS OR NUMERALS

1 CONNECTOR ASSEMBLY
10 MALE CONNECTOR
20, 20B MALE TERMINAL
21 TAB
22 CIRCULAR PORTION
221 INNER HOLE
22B U-SHAPED PORTION
222 SLIT
30 MALE-SIDE INNER HOUSING
31 TERMINAL HOLDING PORTION
311 TERMINAL HOLDING HOLE
313 EXTENDING PORTION
314 INSERTION GROOVE
314*a* FIRST ARM INSERTING PORTION
314*b* FIRST PROTRUDED PORTION
315 CUTOUT
315*a* SECOND ARM INSERTING PORTION
315*b* PEDESTAL INSERTING PORTION
315*c* PROTRUDED PORTION
32 INNER FLANGE
33 MALE-SIDE INNER CYLINDER PORTION
40, 40B PARTITION MEMBER
41 RIB
42 FIRST SUPPORT ARM
421 ENGAGEMENT GROOVE
43 SECOND SUPPORT ARM
431 CONCAVE PORTION
431*a* FIRST FACE
431*b* SECOND FACE
44 FIRST CONNECTION BAR
45 SECOND CONNECTION BAR
46 NUT
461 MAIN BODY PORTION
462 PEDESTAL PORTION
463 SCREW HOLE
47 BOLT
471 HEAD PORTION
472 SCREW PORTION
50 MALE-SIDE OUTER HOUSING
53 MALE-SIDE CONVEX PORTION
531 FEMALE SCREW PORTION
60 FEMALE CONNECTOR
70 FEMALE TERMINAL
80 FEMALE-SIDE HOUSING
84 FEMALE-SIDE CONVEX PORTION
86 BOLT
90 ELECTRIC POWER CABLE

The invention claimed is:

1. A terminal block comprises a housing which holds a plurality of terminals so as to expose at least one end portion of each of the terminals; and a partition member which includes a partition wall dividing the exposed end portions of the plurality of the terminals, wherein the housing and the partition member are configured to be separate from each other, the terminal block further comprises a nut or bolt, the partition member includes a holding portion holding the nut or the bolt, the housing includes an insertion portion into which the holding portion and a part of the nut or the bolt are inserted along an extending direction of the terminals, the holding portion includes a concave portion which holds the nut or the bolt in the extending direction, and the insertion portion includes an engagement portion which is engaged with a part of the nut or the bolt in a direction which is substantially perpendicular to the extending direction.

2. The terminal block according to claim 1, wherein the partition member further includes a connection portion which connects a plurality of the partition walls.

* * * * *